US008014707B2

(12) United States Patent
Nishiyama et al.

(10) Patent No.: US 8,014,707 B2
(45) Date of Patent: Sep. 6, 2011

(54) DEVELOPING DEVICE AND BLADE ASSEMBLY

(75) Inventors: Hideshi Nishiyama, Nagoya (JP); Tsutomu Suzuki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 342 days.

(21) Appl. No.: 12/340,845

(22) Filed: Dec. 22, 2008

(65) Prior Publication Data

US 2009/0169272 A1 Jul. 2, 2009

(30) Foreign Application Priority Data

Dec. 28, 2007 (JP) ..... 2007-338723

(51) Int. Cl.
*G03G 15/08* (2006.01)

(52) U.S. Cl. ..... 399/284

(58) Field of Classification Search ..... 399/274, 399/284

See application file for complete search history.

(56) References Cited

U.S. PATENT DOCUMENTS

| | | | | |
|---|---|---|---|---|
| 5,278,616 | A | 1/1994 | Hirano et al. | |
| 2002/0003974 | A1 | 1/2002 | Nittani et al. | |
| 2004/0091290 | A1 * | 5/2004 | Yamada et al. | 399/284 |
| 2006/0140683 | A1 * | 6/2006 | Takami | 399/284 |

FOREIGN PATENT DOCUMENTS

JP 2002-341644 11/2002

OTHER PUBLICATIONS

Extended EP Search Report dtd Jun. 16, 2009, EP Appln. 08022065.0.

* cited by examiner

*Primary Examiner* — Hoang Ngo
(74) *Attorney, Agent, or Firm* — Banner & Wicoff, Ltd.

(57) ABSTRACT

A developing device includes: a developing roller, a casing which rotatably supports the developing roller; a thickness regulation blade; and first and second holding members which fix the thickness regulation blade on the casing. The first holding member includes: a first nipping surface which contacts the thickness regulation blade; and a first fixing surface. The second holding member includes: a second nipping surface which opposes the first nipping surface; and a second fixing surface contacting the first fixing surface. The thickness regulation blade includes a positioning opening and is sandwiched between the first nipping surface and the second nipping surface. The first nipping surface includes a projection which is fitted into the positioning opening of the thickness regulation blade.

20 Claims, 7 Drawing Sheets

DEVELOPING DEVICE AND BLADE ASSEMBLY

CROSS-REFERENCE TO RELATED APPLICATION

This application claims priority from Japanese Patent Application No. 2007-338723, filed on Dec. 28, 2007, the entire subject matter of which is incorporated herein by reference.

TECHNICAL FIELD

Aspects of the present invention relates to a developing device and a blade assembly having a layer thickness regulation blade which slidably contacts a developing roller to regulate the thickness of a developing agent.

JP-A-2002-341644 describes a blade assembly provided in a developing device in which a layer thickness regulation blade whose base end is held while nipped between two holding members formed of sheet metal. And, the holding members are fixed to a casing of the developing device. Generally, in such a blade assembly, the layer thickness regulation blade is fixed to the holding members by screws, welding, an adhesive, an adhesive tape, and the like.

Pursuant to recent seize reduction of an image forming apparatus, seize reduction of a developing device and a blade assembly which are constituent parts of the image forming apparatus is demanded. However, if the layer thickness regulation blade is fixed to the holding members by an adhesive or an adhesive tape, an adhesive area sufficient for preventing the adhesive from being peeled is required. Therefore, size reduction in the blade assembly and the developing device cannot be sufficiently achieved.

In the meantime, if the layer thickness regulation blade is fixed to the holding members by screws or welding, distortions occur from the fixed portions to the layer thickness regulation blade. Therefore, it becomes difficult to regulate developing agent on a developing roller to a specific thickness, which eventually might cause quality of image to decrease.

SUMMARY

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the present invention to provide a developing device and a blade assembly which prevent occurrence of distortions of the layer thickness regulation blade, and which achieve seize reduction thereof.

According to an exemplary embodiment of the present invention, there is provided a developing device including: a developing roller which carries developing agent on a surface thereof, a casing which rotatably supports the developing roller; a thickness regulation blade which slidably contacts the developing roller to regulate a thickness of the developing agent on the developing roller; and first and second holding members which fix the thickness regulation blade on the casing. The first holding member includes: a first nipping surface which contacts the thickness regulation blade; and a first mounting section including a first fixing surface which extends in a direction different from a direction in which the first nipping surface extends. The second holding member includes: a second nipping surface which opposes the first nipping surface; and a second mounting section including a second fixing surface which extends in a direction different from a direction in which the second nipping surface extends, the second fixing surface contacting the first fixing surface. The thickness regulation blade includes a positioning opening and is sandwiched between the first nipping surface and the second nipping surface. The first holding member and the second holding member are fixed to each other with the first mounting section and the second mounting section. At least one of the first holding member and the second holding member is attached to the casing by the first mounting section or the second mounting section. The first nipping surface includes a projection which is fitted into the positioning opening of the thickness regulation blade.

According to another exemplary embodiment of the present invention, there is provided a blade assembly including: a thickness regulation blade which slidably contacts a developing roller to regulate a thickness of developing agent on the developing roller; and first and second holding members which fixes the thickness regulation blade on a casing of a developing device. The first holding member includes: a first nipping surface which contacts the thickness regulation blade; and a first mounting section including a first fixing surface which extends in a direction different from a direction in which the first nipping surface extends. The second holding member includes: a second nipping surface which opposes the first nipping surface; and a second mounting section including a second fixing surface which extends in a direction different from a direction in which the second nipping surface extends, the second fixing surface contacting the first fixing surface. The thickness regulation blade includes a positioning opening and is sandwiched between the first nipping surface and the second nipping surface. The first holding member and the second holding member are fixed to each other with the first mounting section and the second mounting section. At least one of the first holding member and the second holding member is attached to the casing by the first mounting section or the second mounting section. The first nipping surface includes a projection which is fitted into the positioning opening of the thickness regulation blade.

BRIEF DESCRIPTION OF THE DRAWINGS

The above and other aspects of the present invention will become more apparent and more readily appreciated from the following description of exemplary embodiments of the present invention taken in conjunction with the attached drawings, in which.

DETAILED DESCRIPTION

<Overall Configuration of a Color Printer>

Figure 1:
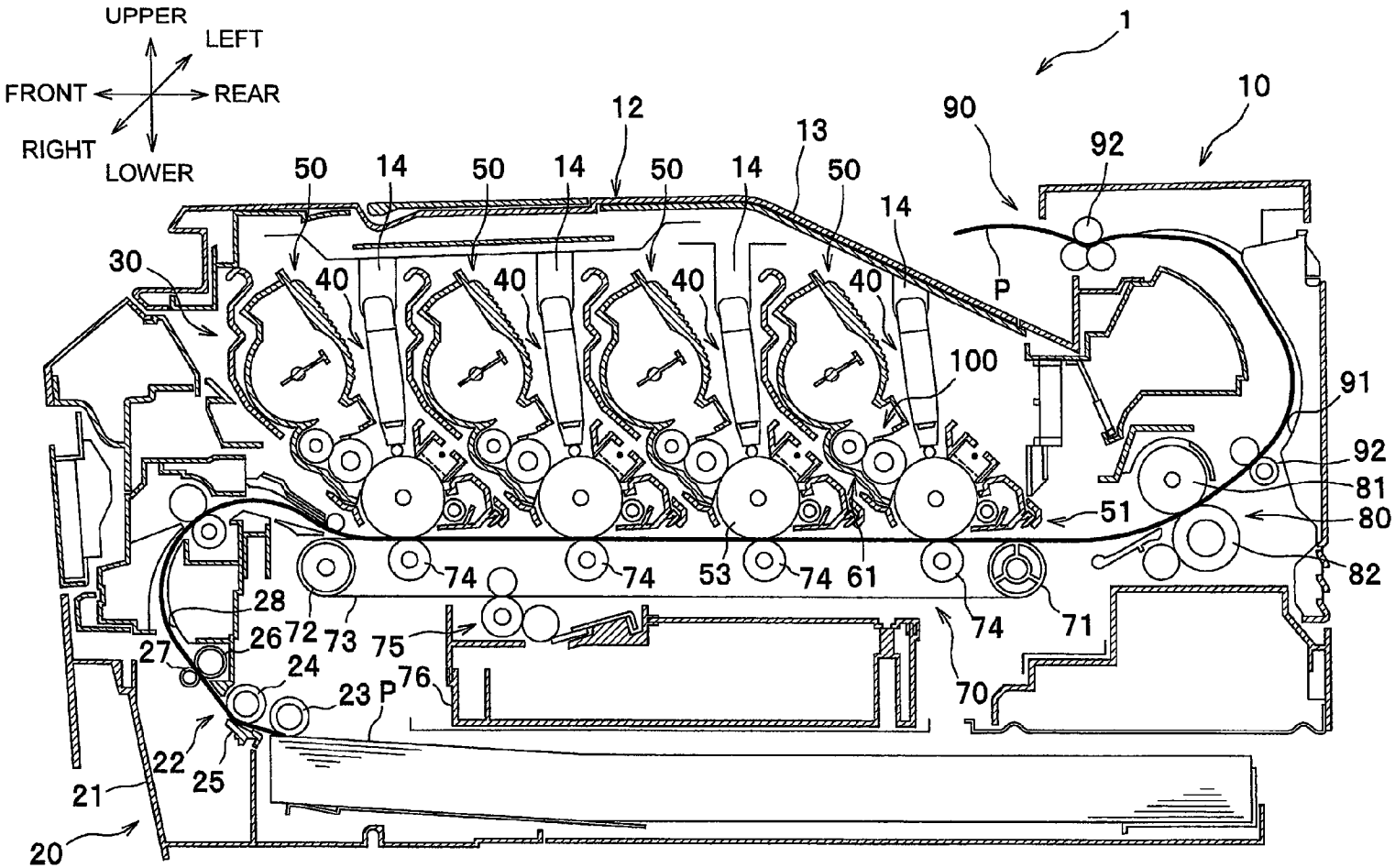
FIG. 1 is a cross-sectional view showing the overall configuration of a color printer according to an exemplary embodiment of the present invention.

An exemplary embodiment of the present invention will be described in detail with reference to the drawings. In the drawings, FIG. 1 is a cross-sectional view showing the overall configuration of a color printer according to an exemplary embodiment of the present invention, and FIG. 2 is cross-sectional view showing the configuration of a process cartridge according to an exemplary embodiment of the present invention.

In the following descriptions, directions will be described with reference to user's directions when the color printer is in use. Specifically, in FIG. 1, the left side of the sheet is taken as "front"; the right side of the sheet is taken as "rear"; a direction away from the viewer in the sheet is taken as "left"; and a direction toward the viewer in the sheet is taken as "right." The vertical direction of the sheet is taken as the "vertical (upper and lower) direction."

Figure 2:
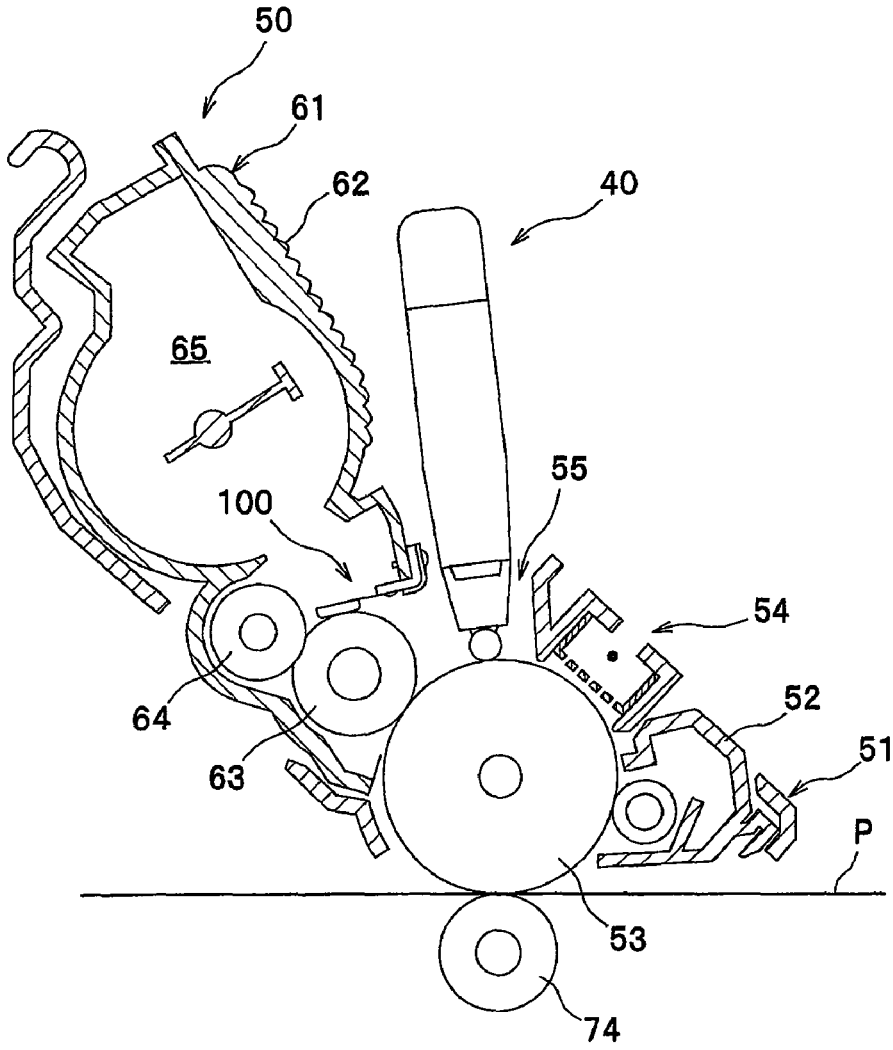
FIG. 2 is cross-sectional view showing the configuration of a process cartridge according to an exemplary embodiment of the present invention.

As shown in FIG. 1, a color printer 1 includes, within a main-body housing 10, a sheet feeding section 20 for feeding a sheet P; an image forming section 30 for forming an image on the thus-fed sheet P; and a sheet discharging section 90 that discharges the sheet P on which an image is formed.

An upper cover 12 is provided at an upper portion of the main-body housing 10 so as to be vertically pivotable about a hinge (not shown) provided at a rear side as a fulcrum. The main-body housing 12 has an opening at an upper portion thereof. The upper cover 12 is capable of opening and closing the opening of the main-body housing 10. An upper surface of the upper cover 12 constitutes a sheet discharging tray 13 for staking the sheets P discharged from the main-body housing 10, and a lower surface of the same is provided with a plurality of holding members 14 each of which holds a LED unit 40.

The sheet feeding section 20 includes a sheet feeding tray 21 that is provided in a lower inner portion of the main-body housing 10 and that is removably attached to the main-body housing 10; and a sheet feeding mechanism 22 that conveys the sheets P from the sheet feeding tray 21 to the image forming section 30. The sheet feeding mechanism 22 is provided on the right side of the sheet feeding tray 21 and includes a feed roller 23, a separation roller 24, and a separation pad 25.

In the sheet feeding section 20 configured as described above, the sheets P housed in the sheet feeding tray 21 are separated one at a time and fed upwardly. After paper powder is removed during the course of the sheet passing between a paper powder removal roller 26 and a pinch roller 27, the sheet passes through a conveyance path 28, to thus be turned rearward and fed to the image forming section 30. The image forming section 30 includes four LED units 40; four process cartridges 50; a transfer unit 70; and a fixing unit 80.

The LED units 40 are disposed to oppose upper surfaces of the respective photosensitive drums 53. The surface of each photosensitive drum 53 is exposed to light emitted from a light-emission section (reference numeral is omitted) provided at a tip end of corresponding LED unit 40 (lower end in FIG. 1). Since the LED units 40 are fixed to the upper cover 12 through the holding members 14, respectively, the LED units 40 is retracted upward from the position opposing the photosensitive drum 53 by rotating the upper cover 12 upwardly.

Process cartridges 50 are aligned in a front-to-rear direction between the upper cover 12 and the sheet feeding section 20. As shown in FIG. 2, each of the process cartridges 50 includes a drum unit 51 and a developing device 61 removably attached to the drum unit 51. The process cartridges 50 are different from each other in terms of the color of toner housed in a toner storage chamber 65 of the developing device 61 and are similar to each other in terms of a structure.

Each of the drum units 51 includes: a drum case 52; a photosensitive drum 53 rotatably supported by the drum case 52; and an electrifiers 54, respectively.

By attaching the developing device 61 to the drum case 52, an exposure space 55 through which the photosensitive drum 53 is viewed from the outside is defined. The LED unit 40 is inserted into the exposure space 55 so as to oppose the upper surface of the photosensitive drum 53, as shown in FIG. 2.

The developing device 61 includes a development case (casing) 62; a developing roller 63 and a supply roller 64 that are rotatably supported by the development case 62; and a blade assembly 100. Further, the developing device 61 includes the toner housing chamber 65 that houses toner (developing agent).

As shown in FIG. 1, a transfer unit 70 is interposed between the sheet feeding section 20 and the respective process cartridges 50. The transfer unit 70 includes a drive roller 71, a driven roller 72, a conveyance belt 73, a transfer roller 74, and a cleaning section 75.

The drive roller 71 and the driven roller 72 are provided in parallel while being spaced apart from each other in the front-to-rear direction, and the conveyance belt 73 formed from an endless belt is wound around the drive roller 71 and the driven roller 72. An external surface of the conveyance belt 73 is in contact with the respective photosensitive drums 53. Four transfer rollers 74 that nip the conveyance belt 73 in conjunction with the respective photosensitive drums 53 are disposed inside of the conveyance belt 73 so as to oppose the respective photosensitive drums 53. A transfer bias voltage is applied to the transfer rollers 74 by constant current control operation performed during transfer operation.

The cleaning section 75 is disposed below the conveyance belt 73 and configured so as to remove the toner adhering to the conveyance belt 73 and cause the thus-removed toner to fall into a toner reservoir section 76 disposed below the cleaning section 75.

The fixing unit 80 is disposed at the rear of the respective process cartridges 50 and the transfer unit 70 and includes a heating roller 81 and a pressing roller 82 that is disposed opposite the heating roller 81 and presses the heating roller 81.

In the image forming section 30 configured as described above, surfaces of the respective photosensitive drums 53 are uniformly charged by the electrifiers 54 and subsequently exposed with light emitted from the respective LED units 40. Thereby, the electric potential of exposed areas becomes lower, and electrostatic latent images based on image data are formed on the respective photosensitive drums 53.

The toner in the toner housing chamber 65 is supplied to the developing roller 63 by rotation of the supply roller 64, and the thus-supplied toner enters a space between the developing roller 63 and the blade assembly 100 by rotation of the developing roller 63, whereupon the toner is held on the developing roller 63 as a thin layer of a specific thickness.

The toner held on the developing roller 63 is supplied to the electrostatic latent image formed on the photosensitive drum 53 when the developing roller 63 contacts the photosensitive drum 53 in an opposing manner. Thereby, the toner is selectively held on the photosensitive drum 53, so that the electrostatic latent image is visualized and that a toner image is formed with this reversal development.

As a result of the sheet P fed on the conveyance belt 73 passing between the respective photosensitive drums 53 and the respective transfer rollers 74 disposed inside of the conveyance belt 73, the toner images formed on the respective photosensitive drums 53 are sequentially transferred to the sheet P. When the sheet P passes between the heating roller 81 and the pressing roller 82, the toner images transferred onto the sheet P are thermally fixed.

The sheet discharging section 90 includes a sheet discharging path 91 that is formed so as to upwardly extend from an exit of the fixing unit 80 and turn to the front side, and a plurality of conveyance roller pairs 92 for conveying the sheet P. The sheet P on which the toner images are transferred and thermally fixed is conveyed along the sheet discharging path 91 by the conveyance rollers 92, discharged to the outside of the main-body housing 10, and stacked on the sheet discharging tray 13.

<Configuration of the Blade Assembly>

Figure 3:
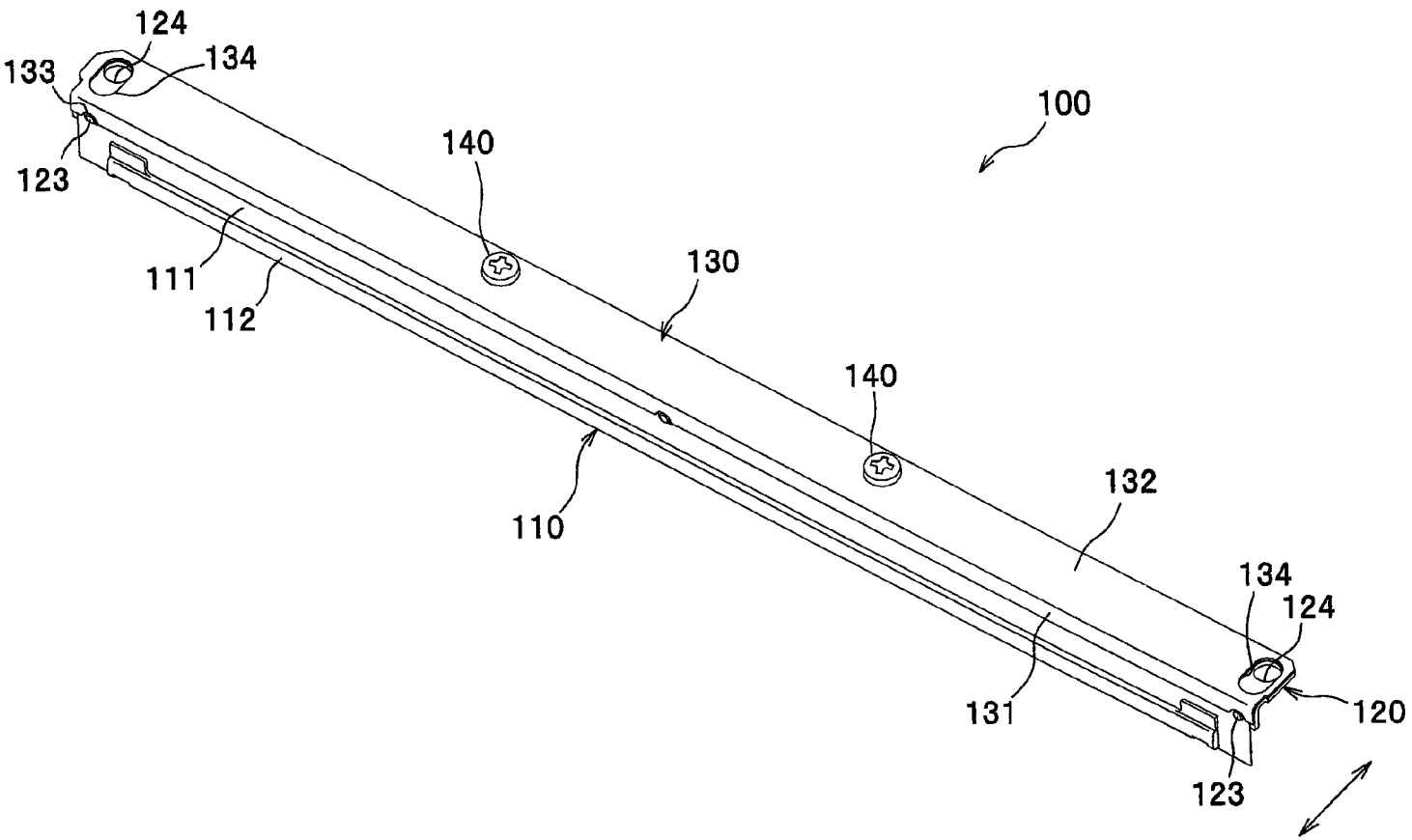
FIG. 3 is a perspective view of a blade assembly according to an exemplary embodiment of the present invention.
Figure 4:
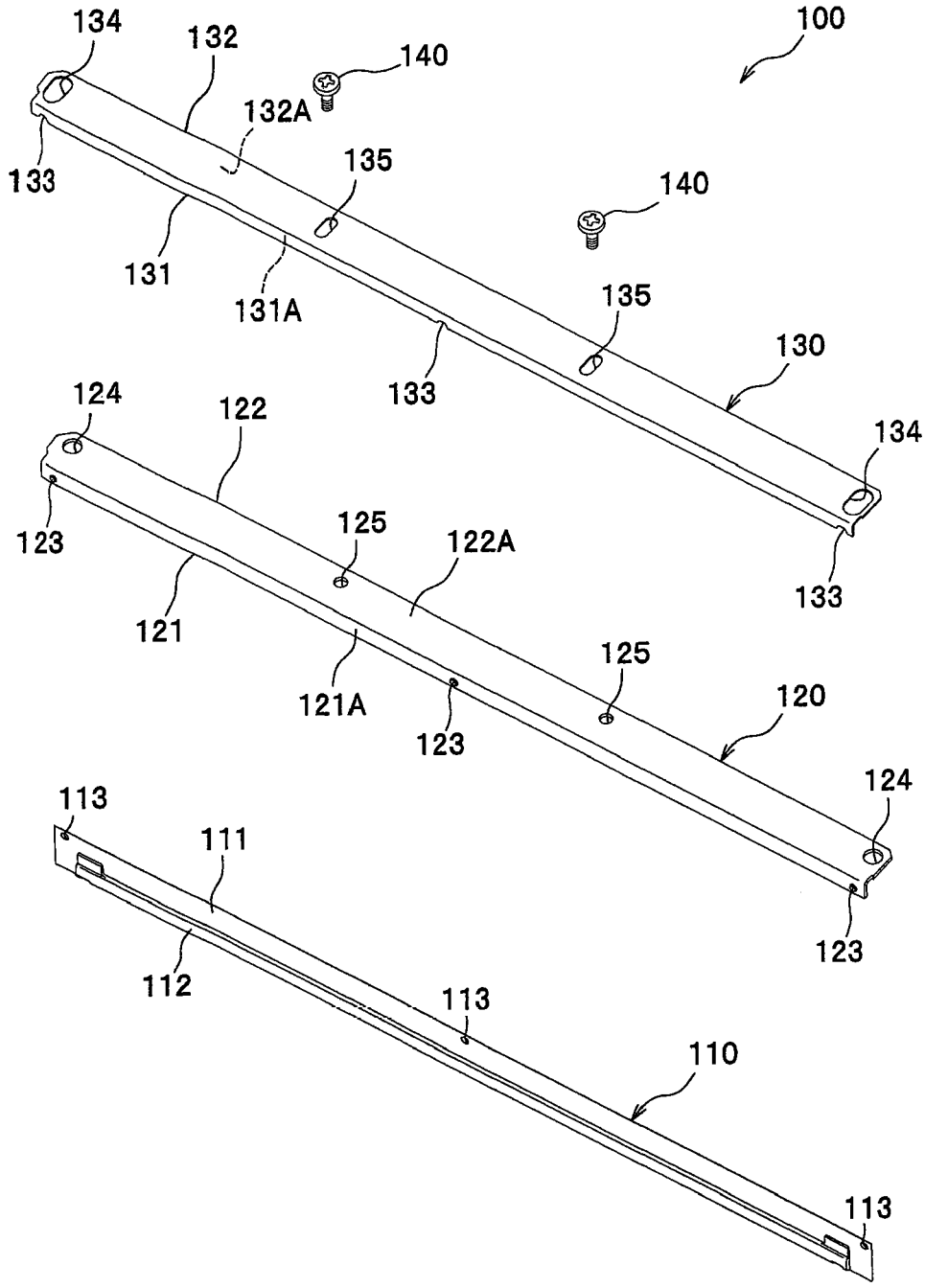
FIG. 4 is an exploded perspective view of the blade assembly shown in FIG. 3.

The detailed configuration of the blade assembly 100 according to an exemplary embodiment of the present invention will now be described. FIG. 3 is a perspective view of the blade assembly; FIG. 4 is an exploded perspective view of the blade assembly shown in FIG. 3; and FIG. 5 is a side view of the blade assembly shown in FIG. 3.

In the following descriptions, a tip end (side) of the layer thickness regulation blade refers to a side where the layer thickness regulation blade slidably contacts the developing roller, and a base end (side) of the layer thickness regulation blade refers to a side where the layer thickness regulation blade is held by a blade holder and a blade reinforcement (supporting) plate.

As shown in FIGS. 3 and 4, the blade assembly 100 includes a layer thickness regulation blade 110, a blade holder 120, and a blade reinforcement (supporting) plate 130.

Figure 5:
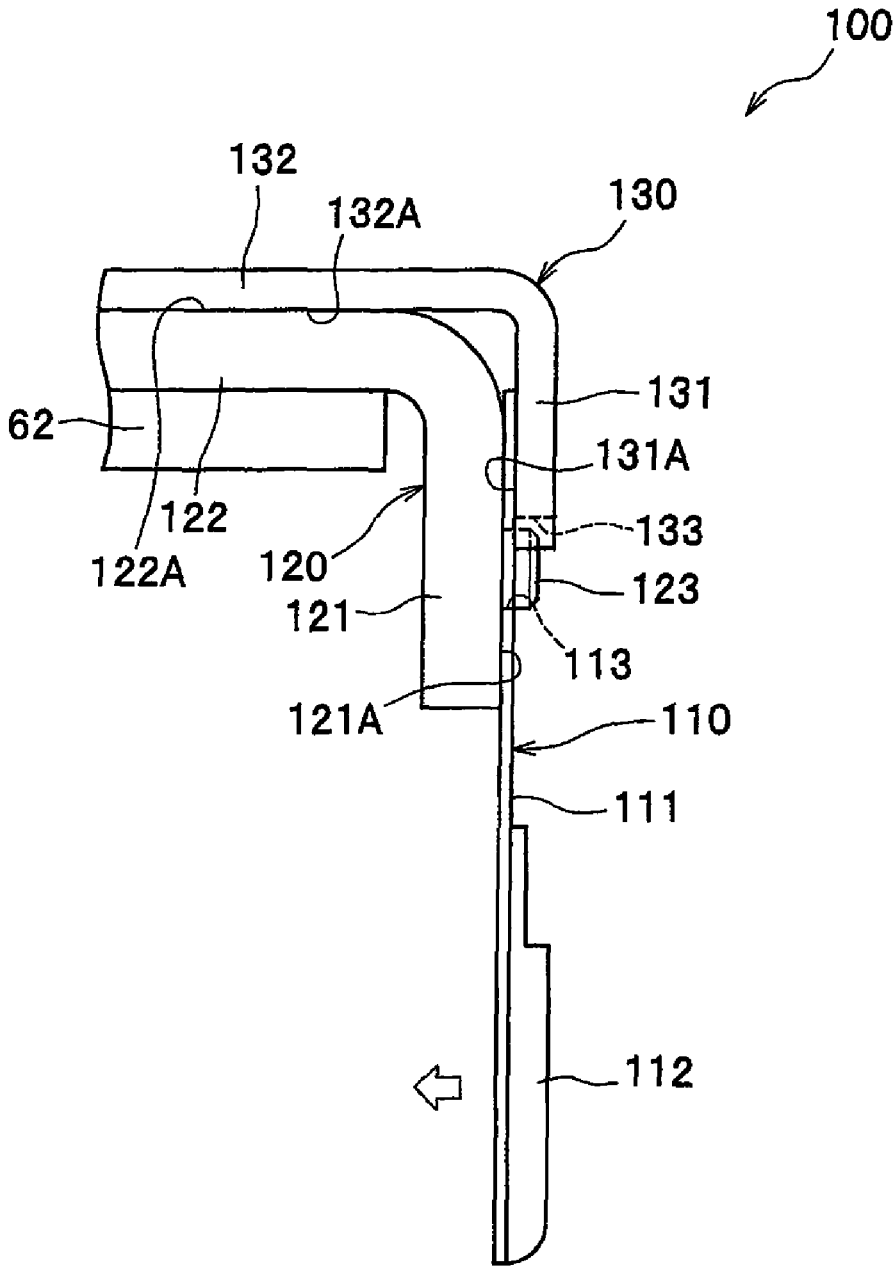
FIG. 5 is a side view of the blade assembly shown in FIG. 3.

As shown in FIG. 5, the layer thickness regulation blade 110 is arranged between the blade holder 120 and the blade reinforcement plate 130. The blade holder 120 is provided on a side where the blade holder 120 contacts the development case 62, and the blade reinforcement plate 130 is disposed on a side where the blade reinforcement plate 130 does not contact the development case 62, that is, an opposite side (an external side) of the development case 62 with respect to the blade holder 120.

As shown in FIG. 4, the layer thickness regulation blade 110 includes a plate member 111 and a pressing member 112 provided at a tip end side (lower end side in FIG. 4) of the plate member 111. The plate member 111 is formed from a rectangular and thin metal plate and has resiliency, which generates urging force toward the developing roller 63. The pressing member 112 is a rubber-like member and formed to have a cross-sectional profile (see FIG. 5) which bulges toward the developing roller 63. The bulging portion is configured to slidably contact with the developing roller 63, directly, to regulate the thickness of the toner held on the surface of the developing roller 63.

The plate member 111 includes positioning openings 113 formed in a base-end side (an upper end side) so as to correspond to projections 123 of a blade holder 120 to be described later. Three of the positioning openings 113 are formed in total at both ends and the center of the plate member 111 in its longitudinal direction (an axial direction of the developing roller 63).

The blade holder 120 is formed by bending a plate member of metal by a substantially right angle (see FIG. 5). The blade holder 120 includes a nipping section 121 extending in the vertical direction of the drawing and a mounting section 122 extending in a direction substantially orthogonal to the nipping section 121. In this exemplary embodiment, the mounting section 122 extends from the nipping section 121 in a direction from a surface of the layer thickness regulation blade 110, contacting the developing roller 63 to the opposite surface thereof.

The nipping section 121 is for nipping the layer thickness regulation blade 110 (the plate member 111) together with a nipping section 131 of a blade reinforcement plate 130 to be described later. An external surface of the nipping section 121, that is, a surface facing a viewer side of FIG. 4, serves as a first nipping surface 121A to be in contact with the layer thickness regulation blade 110 (the plate member 111). The projections 123 to be fitted into the corresponding positioning openings 113 of the layer thickness regulation blade 110 are formed on the first nipping surface 121A. Three of the projections 123 are formed in total at both ends and the center of the first nipping surface 121A in its longitudinal direction (the axial direction of the developing roller 63).

The mounting section 122 includes a first fixing surface 122A to be in contact with a second fixing surface 132A of a mounting section 132 of the blade reinforcement plate 130 to be described later. Additionally, the mounting section serves as an area to be attached to the development case 62 together with the mounting section 132. Specifically, both ends of at least an inner surface of the mounting section 122 (an opposite surface of the first fixing surface 122A), that is, both ends of a lower surface of the mounting section 122 in FIG. 4 is an area attached to the development case 62 while contacting the development case 62, and substantially-circular mounting holes 124 are formed at the both ends of the mounting section 122, respectively. The mounting holes 124 are used for attaching the mounting section 122 to the development case 62 with screws. A pair of screw mounting holes 125 used for joining the blade holder 120 to the blade reinforcement plate 130 to be described later are formed in an area located between the pair of mounting holes 124. The pair of mounting holes 124 and the pair of screw mounting holes 125 are arranged at substantially equal intervals along the longitudinal direction of the mounting section 122.

A screw hole having a threaded inner peripheral surface or a hole having a cylindrical surface to be threaded by a screw when the screw is attached to the hole may also be employed as the screw mounting holes 125.

The blade reinforcement plate 130 is formed by bending a plate member of metal at a substantially right angle (see FIG. 5). The blade reinforcement plate includes the nipping section 131 vertically extending in the drawing and a mounting section 132 extending in a direction substantially orthogonal to the nipping section 131. In this exemplary embodiment, the mounting section 132 extends from the nipping section 131 in a direction from a surface of the layer thickness regulation blade 110, contacting the developing roller 63 to the opposite surface thereof.

The nipping section 131 is for nipping the layer thickness regulation blade 110 (the plate member 111) together with the nipping section 121 of the blade holder 120. An internal surface of the nipping section 131, that is, a surface facing a side away from the viewer in FIG. 4, serves as a second nipping surface 131A to be in contact with the layer thickness regulation blade 110 (the plate member 111) and opposes the first nipping surface 121A of the blade holder 120, and substantially-semicircular cutouts 133 (release opening) are formed in a lower end of the nip section 131 in order to avoid the respective projections 123 formed on the first nipping surface 121A of the blade holder 120. Three of the cutouts 133 are formed in total at both ends and the center of the lower end of the nipping section 131 in its longitudinal direction (the axial direction of the developing roller 63).

The mounting section 132 has the second fixing surface 132A in an internal surface thereof, that is, a lower surface shown in FIG. 4, to be in contact with the first fixing surface 122A of the mounting section 122 of the blade holder 120. A pair of mounting holes 134 formed at the corresponding positions to the pair of mounting holes 124 of the blade holder 120 and a pair of screw mounting holes 135 formed at the corresponding positions to the pair of screw mounting holes 125 of the blade holder 120 are formed in the mounting section 132. The mounting holes 134 and the screw mounting holes 135 are formed into a substantially-oval shape that is larger (longer) in a direction orthogonal to the longitudinal direction of the mounting section 132 (the axial direction of the development roller 63).

As shown in FIG. 5, the projections 123 of the blade holder 120 are provided at position closer to the tip end side (lower side) of the layer thickness regulation blade 110 than the lower end of the blade reinforcement plate 130. In other words, the length of the first nipping surface 121A of the blade holder 120 in the vertical direction of the drawing (the direction orthogonal to the axial direction of the developing roller 63) is longer than the length of the second nipping surface 131A of the blade reinforcement plate 130 in the vertical direction of the drawing. Additionally, the blade holder 120 is formed from a plate member which is thicker than the blade reinforcement plate 130.

According to the above configuration, the following effects can be obtained.

The blade assembly 100 is assembled by fitting the positioning openings 113 of the layer thickness regulation blade 110 around the projections 123 of the blade holder 120 and screwing the screws 140 from the direction of the blade reinforcement plate 130 into the screw mounting hole 125 of the blade holder 120 while the layer thickness regulation blade 110 is nipped between the first nipping surface 121A of the blade holder 120 and the second nipping surface 131A of the blade reinforcement plate 130 (see FIG. 5). At this time, the screws 140 are screwed while the nipping section 131 is pressed against the nipping section 121. Accordingly, the layer thickness regulation blade 110 can be held firmly.

As shown in FIG. 5, the layer thickness regulation blade 110 is fixed by sandwiching the layer thickness regulation blade 110 between the first nipping surface 121A of the blade holder 120 and the second nipping surface 131A of the blade reinforcement plate 130. Further, the projections 123 are fitted into the positioning openings 113, whereupon displacement of the layer thickness regulation blade 110 is suppressed. In particular, in the exemplary embodiment, the projections 123 and the positioning openings 113 are formed at both ends and center of each of the first nipping surface 121A and the plate-like member 111 in the longitudinal direction thereof, and therefore, the displacement of the layer thickness regulation blade 110 can be effectively reduced or prevented.

In the exemplary embodiment, the mounting holes 134 and the screw mounting holes 135 are formed into a substantially-oval shape which is longer than the mounting section 132 in a direction orthogonal to the longitudinal direction. Therefore, even when an error occurs in the dimension or shape of the blade holder 120 or the blade reinforcement plate 130, the layer thickness regulation blade 110 can be nipped at appropriate positions by adjusting a position where the blade reinforcement plate 130 is fixed by a screw.

The blade assembly 100 assembled as described above is fixed to the development case 62 by screws though the mounting holes 134 and 124 formed at both ends (see FIG. 2). In the exemplary embodiment, the blade assembly is fixed to the development case 62 from outside thereof, however, it is not limited thereto. In relation to the blade assembly 100, the layer thickness regulation blade 110 (the press member 112) is configured to contact the developing roller 63 in the development unit 61. At the time of forming an image, the toner supplied to the developing roller 63 from the supply roller 64 is regulated to a specific thickness between the developing roller 63 and the layer thickness regulation blade 110 (the press member 112) with rotation of the developing roller 63, thereby allowing the developing roller 63 to carry the toner in the specific thickness layer. At this time, the developing roller 63 exerts force on the layer thickness regulation blade 110 (the plate member 111) in the direction of an arrow shown in FIG. 5.

In the exemplary embodiment, the first nipping surface 121A is formed longer than the second nipping surface 131A in the direction orthogonal to the axial direction of the developing roller 63. Therefore, the first nipping surface 121A surely supports (fixes) the base-end side of the layer thickness regulation blade 110 against the force applied in the direction of the arrow shown in FIG. 5, and the second nipping surface 131A acts as a presser for the base end side of the layer thickness regulation blade 110. Since the blade holder 120 is formed so as to become thicker than the blade reinforcement plate 130, the first nipping surface 121A determines the attitude of the layer thickness regulation blade 110, and the second nipping surface 131A acts as a press for the layer thickness regulation blade 110. Thereby, the accuracy of attitude of the layer thickness regulation blade 110 achieved at the time of forming an image can be enhanced. Further, the thickness of the toner on the developing roller 63 can be regulated more uniformly than in the related art.

According to the blade assembly 100 as described in the exemplary embodiment, the layer thickness regulation blade 110 can be fixed to the blade holder 120 and the blade reinforcement plate 130 without imparting fastening force of the screws directly to the layer thickness regulation blade 110 or welding the layer thickness regulation blade 110. Moreover, the blade holder 120 and the blade reinforcement plate 130 are attached to the development case 62 by the mounting sections 122 and 132 (the first fixing surface 122A and the second fixing surface 132A) extending in a direction substantially orthogonal to the nipping sections 121 and 131 (the first nipping surface 121A and the second nipping surface 131A). Therefore, the influence of distortions occurring in mounted areas can be reduced or prevented from exerting on the layer thickness regulation blade 110. On this account, occurrence of distortions of the layer thickness regulation blade 110 can be reduced or prevented, and therefore, the thickness of the toner on the developing roller 63 can be uniformly regulated with superior accuracy. As a result, the quality of an image formed by the color printer 1 can be maintained well.

Since an adhesive, an adhesive tape, and the like, are not used, the vertical dimensions of the first nipping surface 121A and the second nipping surface 131A (the nipping sections 121 and 131) can be made smaller than in the case where an adhesive, an adhesive tape, and the like, is used. Moreover, the nipping surfaces 121A and 131A and the fixing surfaces 122A and 132A extend in different directions. Therefore, the dimension of a direction (the vertical direction in the drawing) in which the respective nipping surfaces 121A and 131A extend can be reduced when compared with the case where the nipping surfaces are attached to a casing within the same plane as that of the blade (i.e., within the nipping surfaces). As a result, the size of the blade assembly 100 can be totally reduced. Therefore, use of such a blade assembly 100 in the development unit 61 enables reduce the size of the development unit 61, and therefore, the size of the color printer 1 can be reduced. Moreover, as a result of size reduction of the blade assembly 100, material cost can be curtailed.

Since the cutouts 133 are formed along the lower end of the nipping section 131, the dimension of the nipping section 131 in the vertical direction of the drawing can be reduced, whereby a wide contact area can be ensured at a position between the second nipping surface 131A and the layer thickness regulation blade 110. As a result, the layer thickness regulation blade 110 can be surely held (fixed) between the first nipping surface 121A and the second nipping surface 131A while the size of the blade assembly 100 is reduced.

Since the blade holder 120 and the blade reinforcement plate 130 are formed by bending a plate member made of metal, they can be molded readily by sheet metal processing and manufactured at low cost. Moreover, the blade holder 120 and the blade reinforcement plate 130 can fasten the layer thickness regulation blade 110 without use of an adhesive, an adhesive tape, or the like, and can be mounted to the development case 62 with screws. Hence, the blade holder and the blade reinforcement plate can be recycled.

While the present invention has been shown and described with reference to certain exemplary embodiments thereof, it will be understood by those skilled in the art that various changes in form and details may be made therein without departing from the spirit and scope of the invention as defined by the appended claims.

In the above exemplary embodiment, the blade holder 120 and the blade reinforcement plate 130 formed by bending plate members at substantially right angles are used. However, the present invention is not limited thereto. Specifically, the angle at which the plate member is to be bent (the angle formed between the nipping surface of the blade holding member and the fixing surface) may also be an angle other than the right angle.

In the above exemplary embodiment, the blade holder 120 and the blade reinforcement plate 130 formed by bending plate members at substantially right angles, that is, the same angle, are used for the blade holder 120 and the blade reinforcement plate 130. However, the present invention is not limited thereto. Specifically, the blade holder (the first holding member) and the blade reinforcement plate (the second holding member) may also be bent at different angles.

Figure 6:
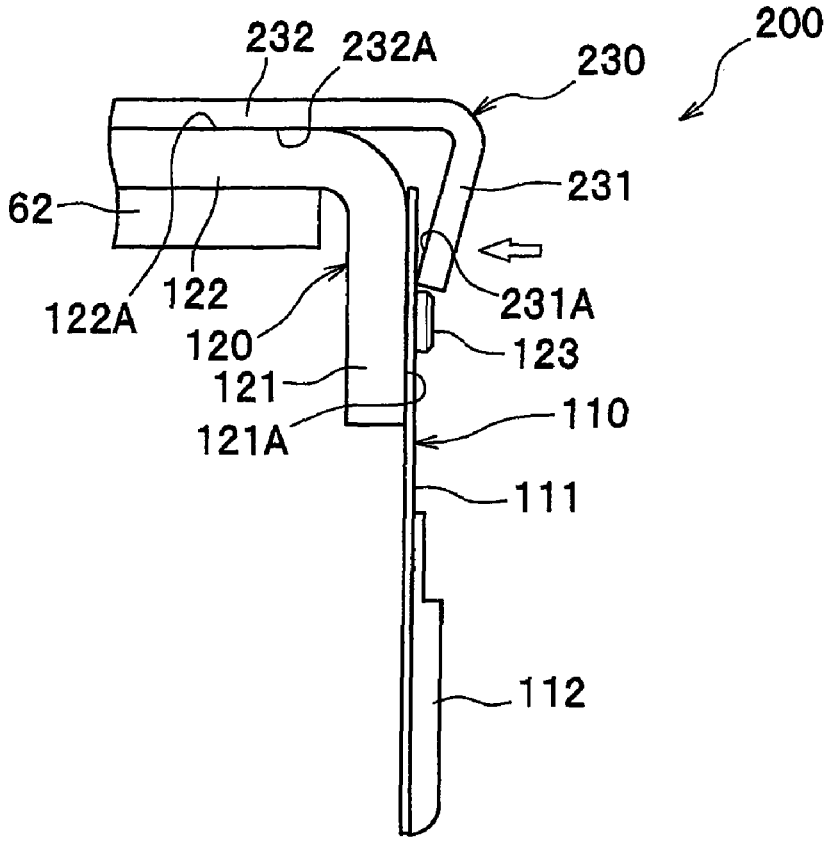
FIG. 6 is a side view of a blade assembly according to a first modified exemplary embodiment of the present invention.

For example, FIG. 6 shows a side view of a blade assembly 200 according to a first modified exemplary embodiment of the present invention. As shown in FIG. 6, a bending angle of a blade reinforcement plate 230 disposed on the opposite side (which is called an outside) of the development case 62 with respect to the blade holder 120 may also be smaller than a bending angle of the blade holder 120 disposed on a part (which is called an inside) of the development case 62. Specifically, an angle formed between the second nipping surface 231A and the second fixing surface 232A may be smaller than an angle formed between the first nipping surface 121A and the first fixing surface 122A. According to this configuration, the assembly is performed while the nipping section 231 is pressed against the nipping section 121, whereupon force occurs in the nipping section 231 in the direction of the arrow shown in FIG. 6. Thus, the second nipping surface 231A (the tip end of the nipping section 231) presses the layer thickness regulation blade 110 toward the first nipping surface 121A, so that the layer thickness regulation blade 110 can be firmly held between the first nipping surface 121A and the second nipping surface 231A.

Figure 7:
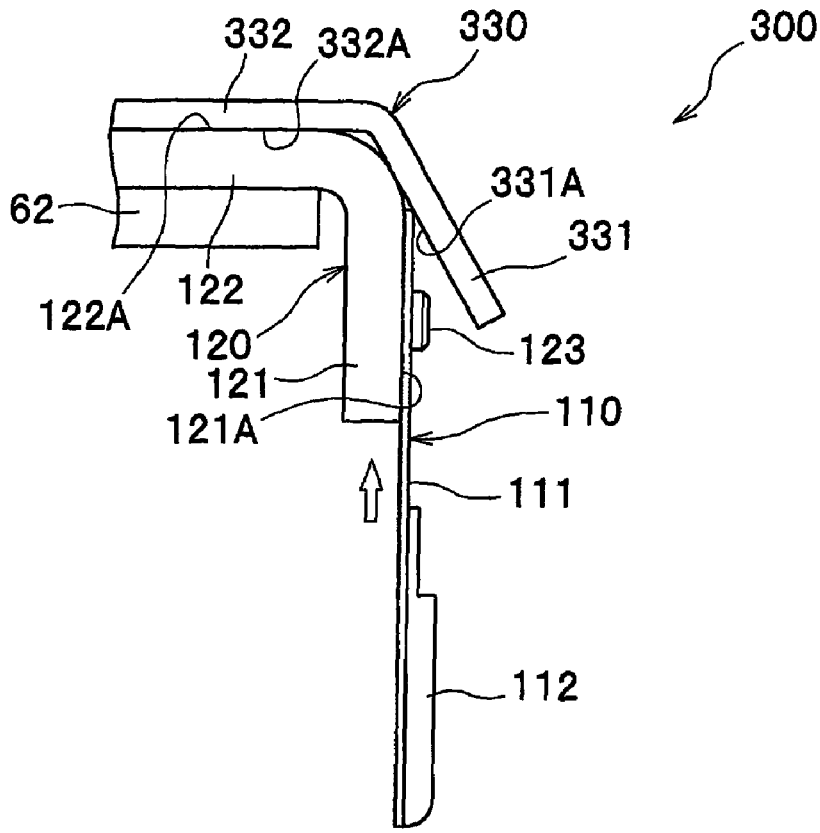
FIG. 7 is a side view of a blade assembly according to a second modified exemplary embodiment of the present invention.

FIG. 7 is a side view of a blade assembly 300 according to a second modified exemplary embodiment of the present invention. As shown in FIG. 7, the bending angle of the blade holder 120 disposed inside may be greater than the bending angle of the blade reinforcement plate 330 disposed outside. Specifically, the angle formed between the second nipping surface 331A and the second fixing surface 332A may be greater than an angle formed between the first nipping surface 121A and the first fixing surface 122A. According to this configuration, the layer thickness regulation blade 110 (the plate-like member 111) can effect deflection over its entire length along the vertical direction of the drawing. Therefore, even when the vertical dimension of the layer thickness regulation blade 110 is reduced, deflection of the layer thickness regulation blade 110 can be ensured. Moreover, the base end edge (the upper end in the drawing) of the layer thickness regulation blade 110 is set to the dimension at which the blade contacts the blade reinforcement plate 330. Even when force is induced by rotation of the developing roller 63 in the direction of an arrow shown in FIG. 7, the base end edge is regulated by the blade reinforcement plate 330, so that displacement of the layer thickness regulation blade 110 can be suppressed thoroughly.

Although the exemplary embodiment describes the case where the blade holder 120 is formed from a plate member which is thicker than the blade reinforcement plate 130, the present invention is not limited thereto. For example, the blade holder may also be formed from, for example, a plate member having the same thickness as that of the blade reinforcement plate.

The exemplary embodiment describes the case where the first nipping surface 121A is longer than the second nipping surface 131A in the direction orthogonal to the axial direction of the developing roller 63 (the vertical direction in FIG. 5). However, the present invention is not limited thereto. For example, the first nipping surface and the second nipping surface may have same length in the direction orthogonal to the axial direction of the developing roller.

The exemplary embodiment describes the cutouts 133 formed into a substantially-semicircular shape that avoids the projections. However, the present invention is not limited thereto. For example, the cutouts may also be a rectangular cutout, or the release openings may be formed into the shape of a hole.

The exemplary embodiment provides the case where three of the projections 123 are formed at both ends and the center of the first nipping surface 121A in its longitudinal direction (the axial direction of the developing roller 63). However, the present invention is not limited thereto. For example, the projections may be formed only at both ends of the first nipping surface in the axial direction of the developing roller, or two or more projections may also be formed in an area between projections provided at both ends. In this case, the positioning openings of the layer thickness regulation blade and the release openings of the second holding member are formed in correspondence with the projections. Further, a single projection may be formed on the first nipping surface and a single positioning opening may be formed on the layer thickness regulation blade in correspondence with the projection.

The exemplary embodiment describes the case where the layer thickness regulation blade 110 is formed from the plate member 111 and the press member 112. However, the present invention is not limited thereto. For example, a layer thickness regulation blade formed from, for instance, a rectangular and thin metal plate not having a rubber-like member may be adopted.

The exemplary embodiment describes the developing device 61 including the developing roller 63, the supply roller 64, the blade assembly 100, and the toner housing chamber 65. However, the developing device according to the present invention is not limited thereto. For example, a developing device not having the toner storage chamber of the foregoing respective constituent elements (i.e., a developing device to which a developing agent cartridge is removably attached) or a developing device (a so-called process cartridge) having a photosensitive drum and an electrifier in addition to the respective foregoing constituent elements may be adopted.

The exemplary embodiment describes the case where the positioning openings 113 are provided on the plate member 111 of the layer thickness regulation blade 100, and the projections 123 are provided on the first nipping surface 121A of the blade holder 120. However, the present invention is not limited thereto. For example, positioning openings may be provided on the first nipping surface 121A and projections provided on the plate member 111 to be fitted into the positioning openings.

What is claimed is:

1. A developing device comprising:

a developing roller which carries developing agent on a surface thereof, a casing which rotatably supports the developing roller;

a thickness regulation blade which slidably contacts the developing roller to regulate a thickness of the developing agent on the developing roller; and first and second holding members which fix the thickness regulation blade on the casing, wherein the first holding member includes:

a first nipping surface which contacts the thickness regulation blade;

a projection formed on the first nipping surface and projecting toward the thickness regulation blade; and a first mounting section including a first fixing surface which extends in a direction different from a direction in which the first nipping surface extends, wherein the second holding member includes:

a second nipping surface which opposes the first nipping surface; and a second mounting section including a second fixing surface which extends in a direction different from a direction in which the second nipping surface extends, the second fixing surface contacting the first fixing surface;

wherein the thickness regulation blade includes a positioning opening and is sandwiched between the first nipping surface and the second nipping surface, wherein the first holding member and the second holding member are fixed to each other with the first mounting section and the second mounting section;

wherein at least one of the first holding member and the second holding member is attached to the casing by the first mounting section or the second mounting section, and wherein the projection fits into the positioning opening of the thickness regulation blade.

2. The developing device according to claim 1, wherein the second nipping surface includes a release opening which avoids the projection of the first nipping surface.

3. The developing device according to claim 1, wherein a length of the first nipping surface in a direction orthogonal to an axial direction of the developing roller is longer than a length of the second nipping surface in a direction orthogonal to the axial direction of the developing roller.

4. The developing device according to claim 1, wherein the projection is provided at at least both ends of the first holding member in an axial direction of the developing roller.

5. The developing device according to claim 1, wherein the first holding member and the second holding member are formed by at least bending plate members, respectively.

6. The developing device according to claim 5, wherein the first holding member is thicker than the second holding member.

7. The developing device according to claim 5, wherein an angle formed between the second nipping surface and the second fixing surface is smaller than an angle formed between the first nipping surface and the first fixing surface.

8. The developing device according to claim 5, wherein an angle formed between the second nipping surface and the second fixing surface is greater than an angle formed between the first nipping surface and the first fixing surface.

9. The developing device according to claim 1, wherein each of the first fixing surface and the second fixing surface includes a mounting hole which is used for fixing the first holding member and the second holding member to the casing with a screw, and wherein the mounting hole of the second holding member is greater than the mounting hole of the first holding member in a direction orthogonal to an axial direction of the developing roller.

10. The developing device according to claim 1, wherein the thickness regulation blade is fixed to the casing by the first and second holding members without using adhesive.

11. The developing device according to claim 1, wherein the thickness regulation blade includes a plate member which has an elasticity; and a rubber-like member provided to the plate member, wherein the positioning opening is provided on the plate member, and wherein the rubber-like member slidably contacts the developing roller.

12. The developing device according to claim 1, wherein the first and second holding members fix the thickness regulation blade on an outside of the casing.

13. The developing device according to claim 1, wherein the thickness regulation blade includes a first blade surface which slidably contacts the developing roller, and a second blade surface opposite to the first blade surface, and wherein the first mounting section and the second mounting section extend from the first nipping section and the second nipping section in a direction from the first blade surface to the second blade surface, respectively.

14. The developing device according to claim 1, wherein the second holding member is separated from the projection.

15. The developing device according to claim 1, wherein the thickness regulation blade is sandwiched between the first nipping surface and the second nipping surface without the second holding member being in contact with the projection.

16. A developing device comprising:

a casing;

a developing roller;

a blade which contacts the developing roller and includes an opening;

a blade holder which has a first mounting section mounted on the casing, a first nipping section and a projection formed on the first nipping section, the projection projecting toward the blade and fitted into the opening; and a blade supporting plate which has a second mounting section mounted on the casing and a second nipping section for nipping the blade together with the first nipping section.

17. The developing device according to claim 16, wherein the blade is sandwiched between the first nipping section and the second nipping section without the blade supporting plate being in contact with the projection.

18. A blade assembly comprising:

a thickness regulation blade which slidably contacts a developing roller to regulate a thickness of developing agent on the developing roller; and first and second holding members which fix the thickness regulation blade on a casing of a developing device, wherein the first holding member includes:

a first nipping surface which contacts the thickness regulation blade;

a projection formed on the first nipping surface and projecting toward the thickness regulation blade; and a first mounting section including a first fixing surface which extends in a direction different from a direction in which the first nipping surface extends, wherein the second holding member includes:

a second nipping surface which opposes the first nipping surface; and a second mounting section including a second fixing surface which extends in a direction different from a direction in which the second nipping surface extends, the second fixing surface contacting the first fixing surface;

wherein the thickness regulation blade includes a positioning opening and is sandwiched between the first nipping surface and the second nipping surface, wherein the first holding member and the second holding member are fixed to each other with the first mounting section and the second mounting section;

wherein at least one of the first holding member and the second holding member is attached to the casing by the first mounting section or the second mounting section, and wherein the projection fits into the positioning opening of the thickness regulation blade.

19. The blade assembly according to claim 18, wherein the second holding member is separated from the projection.

20. The blade assembly according to claim 18, wherein the thickness regulation blade is sandwiched between the first nipping surface and the second nipping surface without the second holding member being in contact with the projection.

* * * * *